United States Patent [19]

Dooley et al.

[11] Patent Number: 4,660,739

[45] Date of Patent: Apr. 28, 1987

[54] LABEL DISPENSER

[75] Inventors: Edward J. Dooley, Holland; Robert A. Bredeweg, Zeeland, both of Mich.

[73] Assignee: Batts, Inc., Zeeland, Mich.

[21] Appl. No.: 709,334

[22] Filed: Mar. 7, 1985

[51] Int. Cl.[4] ..... G07F 11/68

[52] U.S. Cl. ..... 221/70; 221/73; 221/72; 156/DIG. 48

[58] Field of Search ..... 221/70, 71, 73, 72, 221/311; 156/DIG. 48

[56] References Cited

U.S. PATENT DOCUMENTS

| | | | |
|---|---|---|---|
| 2,771,214 | 11/1956 | Lefebvre | 221/70 |
| 2,912,140 | 11/1959 | Cole | 221/70 |
| 3,107,814 | 10/1963 | Auger et al. | 156/DIG. 48 |
| 3,169,895 | 2/1965 | Sohn | 221/73 |
| 3,212,669 | 10/1965 | Kruger | 221/70 |
| 3,889,845 | 6/1975 | Haitmanek | 221/70 |
| 4,496,049 | 1/1985 | Pabodie et al. | 221/73 X |
| 4,525,237 | 6/1985 | Clar | 156/DIG. 48 |

FOREIGN PATENT DOCUMENTS 0349207 11/1960 Switzerland .

*Primary Examiner*—Joseph J. Rolla
*Assistant Examiner*—Jay I. Alexander
*Attorney, Agent, or Firm*—Price, Heneveld, Cooper DeWitt & Litton

[57] ABSTRACT

A dispenser for dispensing small labels such as the tab applied to garment hangers to indicate size is designed to be held and manipulated in one hand leaving the operator's other hand free to apply the label. The dispenser separates labels from a carrier web or tape and deposits them on a holder in a convenient position to be lifted off by the operator and applied. The carrier web or tape can be manipulated to pass through the dispenser and the labels separated by operator using the thumb and index finger of the hand holding the dispenser.

1 Claim, 8 Drawing Figures

LABEL DISPENSER

FIELD OF THE INVENTION

This invention relates to label dispensers for separating self-adhering labels from a carrying web which has been treated to permit ready separation of label and web. More particularly, it is directed to such a dispenser which is not powered and is specifically designed to be held and manipulated in one hand leaving the other hand free to apply the dispensed labels to the object to which they are to be attached such as a garment hanger.

BACKGROUND OF THE INVENTION

It is becoming a more common practice to provide garment hangers used to display garments at the retail level with small panels to which small information labels can be adhesively applied. Hangers having panels for receiving such labels are disclosed in U.S. Pat. Nos. 4,115,940 and 4,450,639. The job of applying the labels can be tedious and time consuming and, at best, is labor intensive. Both the labels and the panels to which they are attached are small. It is also necessary that the labels be carefully attached so they are aligned with the panel because misaligned labels create a negative impression on customers. Even in relatively small retail facilities the number of hangers to be labelled is substantial and in larger establishments the number runs into the thousands. Power driven automatic dispensers have not been successful because of their bulk and weight making it difficult to properly align them with the target panel unless time and care is exercised in using them. As a result, hand application is still the preferred method.

In the case of hand application, the problem has been how to make it possible for the operator to quickly and easily separate the label from the carrier web and still have a free hand to apply the label. Until this invention, this problem had frustrated all attempts to solve it.

BRIEF DESCRIPTION OF THE INVENTION

The invention provides a dispenser which is very light in weight and compact enough to be held in one hand. Its compactness further makes it possible for the operators not only to hold the dispenser in one hand but also to manipulate with the same hand the ribbon-like web of labels through the dispenser to separate the labels and position them such that the operator, with the other hand, can pick off the labels and apply them one by one to the hangers.

DESCRIPTION OF THE PREFERRED EMBODIMENT

Figure 1:
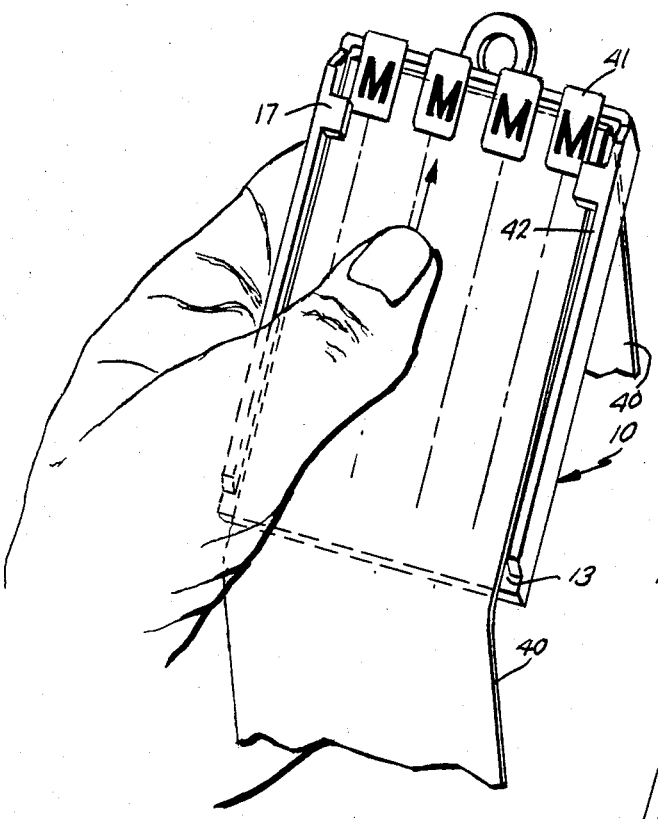
FIG. 1 is an oblique view of a dispenser incorporating this invention as it is held in the operator's hand.
Figure 2:
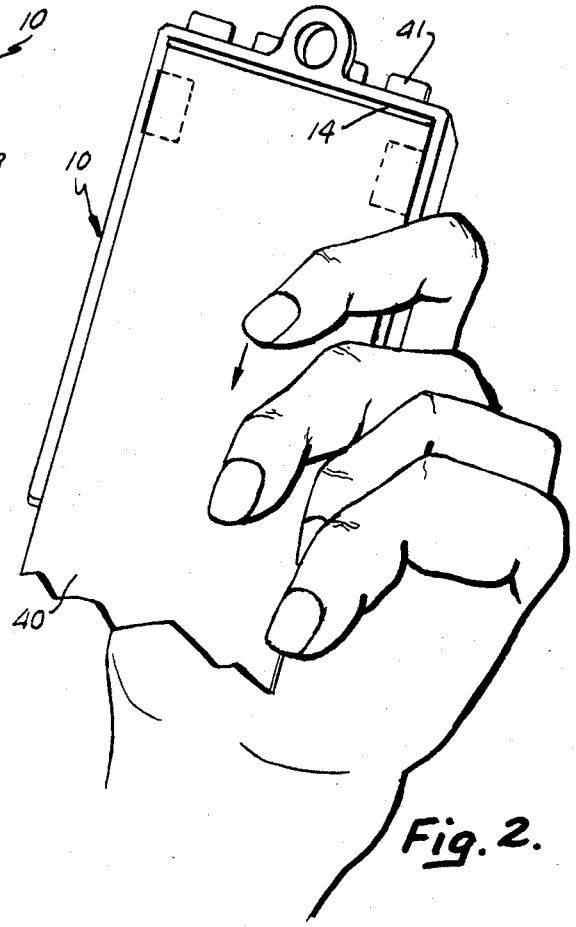
FIG. 2 is an oblique view similar to FIG. 1 but showing the dispenser from the back.
Figure 3:
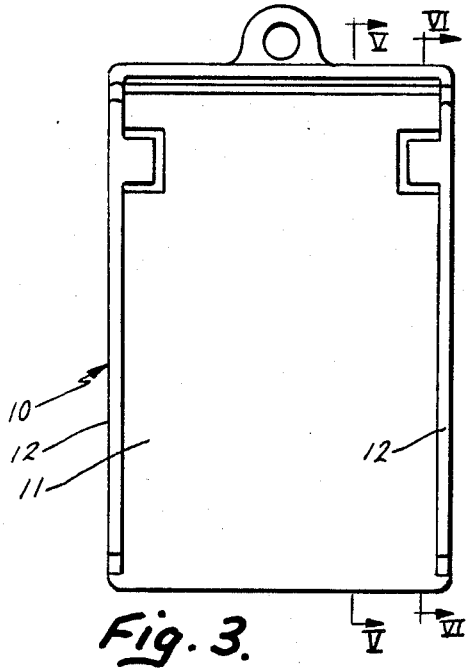
FIG. 3 is a top view of the dispenser.
Figure 5:
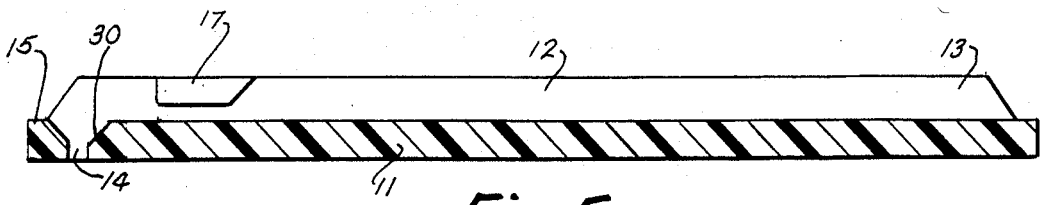
FIG. 5 is a sectional view taken along the plane V—V of FIG. 3.
Figure 6:
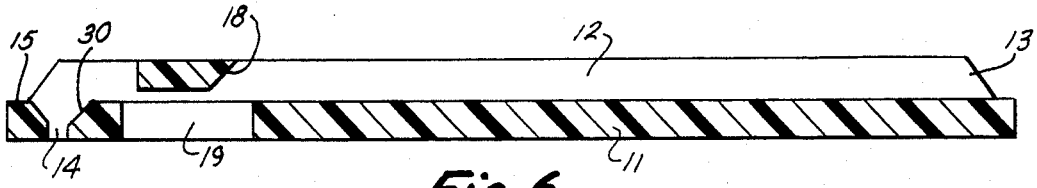
FIG. 6 is a fragmentary sectional view taken along the plane VI—VI of FIG. 3.

The numeral 10 refers to the dispenser body having bottom panel 11 flanked on each side by an upstanding side wall 12 extending substantially the full length of the body (FIG. 3). The side walls 12 together with the bottom panel 11 form a shallow channel 13 open at both ends and of the width to accurately guide a ribbon-like label transporting web lengthwise of the body (FIGS. 1, 5 and 6). At one end a narrow slot 14 opens through the bottom panel 11 and extends transversely of the channel 13 from side wall to side wall. The outer wall of the slot is formed by the edge of a bar 15 which extends the full width of the channel. The bar 15 is narrow lengthwise of the channel and has a top surface co-planar with the top surface of the bottom panel 11.

Adjacent the slot 14 but spaced from it in a direction away from the bar 15, a pair of ears 17 are provided. The ears 17 are integral with the side walls and project inwardly toward each other over the bottom of the channel 13 and spaced from the bottom surface of the channel a distance such that a label transport web and the labels thereon can pass under the ears without interference. The ears 17 extend only a minor distance into the channel leaving a wide passage between them, the importance of which will be made clear subsequently. The downstream edges 18, that is the ones facing away from the slot 14, are sloped downwardly and toward the slot to facilitate the initial introduction or theading of the label transport web beneath the ears. The bottom panel 11 has access openings 19 aligned with the ears which permit the ears to be molded without the necessity of providing the mold with movable cams.

The upper portion of the inner wall 30 of the slot 14 intersects the plane of the top surface of the channel at an acute angle such as 60 to 70 degrees thus creating an abrupt change in direction of anything passing from the channel into the slot. The upper portion of the inner wall does not extend to the lower or back surface of the bottom panel for reasons which will be made clear subsequently. Preferably the lower or back portion of the wall is perpendicular to the back surface of the bottom panel. Both the front and back surfaces of the bottom panel are flat and smooth and will permit a label carrier web to slide over them with minimal friction. The entire dispenser is molded as one integral unit from a suitable plastic such as styrene.

To prepare the dispenser for use, it is loaded with a ribbon-like web 40 to which a plurality of labels 41 are detachably adhered. The web may have a single row or column of labels or plural rows as illustrated. In the case of hanger size identification labels, the small size permits plural rows as illustrated. The web 40, with labels facing upwardly is fed into the channel 13 from the end opposite the slot 14. It is passed under the ears 17 and then downwardly through the slot 14 and its direction reversed to slide back along the back or bottom face of the bottom panel 11. By terminating the inclined portion of the inner wall 30 at a point spaced above the back or lower surface of the bottom panel 11, the formation of a sharp edge at the bottom of the panel is avoided. Such an edge would be undesirable because it would make it difficult to pull the web over it as it reverses direction. The blunt nose which results from the construction utilized avoids this problem. The width of the channel is just enough to permit the web to slide between the side walls 12 without binding yet maintaining accurate alignment with the channel. The web should have a label free lead long enough to permit the head end to extend back at least the length of the dispenser body.

The size of the dispenser body 10 is such that it can be seated in the palm of the operator's hand and gripped between the thumb and the fingers with the thumb extending over the channel at substantially its midpoint. Its width also permits the hand to be closed enough that the index finger can be crooked against the web at the back side of the dispenser and manipulated to cooperate with the thumb to advance the web lengthwise of the dispenser. It is for this reason important that the spacing between the ears 17 be wide so they will not interfere with the operator's thumb.

Figure 7:
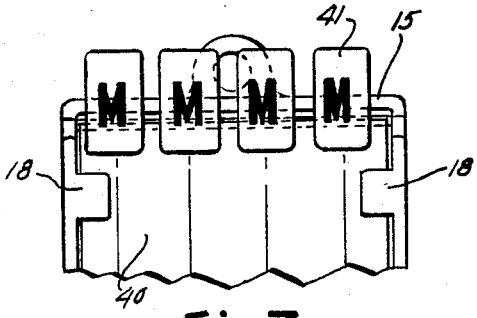
FIG. 7 is a fragmentary top view of the dispenser illustrating the labels being separated from the web.
Figure 4:
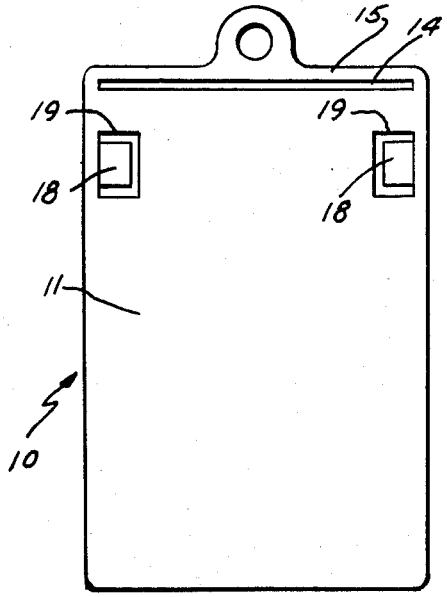
FIG. 4 is a bottom view of the dispenser.
Figure 8:
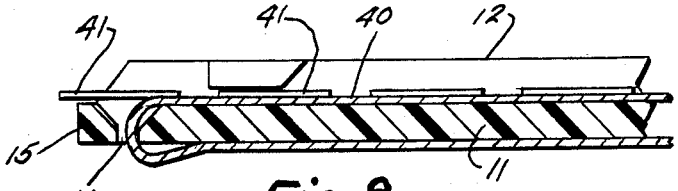
FIG. 8 is a fragmentary sectional view taken along the same plane of FIG. 5 showing the label transport web threaded around the dispenser.

With the loaded dispenser held in the operator's hand as described, the operator manipulates the thumb to push the web or tape forward and the index finger to draw the web back, thus causing the web to abruptly change direction at the lip formed by the intersection of the surface of the bottom of the channel and the inner wall 30. This causes the labels 41 to separate from the web and continue travelling out over the bar 15 (FIG. 7). The labels have sufficient stiffness to project from the web without bending. The thickness of the web 40 holds them above the top surface of the bar until that portion of the web to which the trailing end of the labels are secured starts down over the lip of the slot. This pulls the labels down and deposits them on the bar with a substantial portion of the labels projecting outwardly beyond the bar. This positions the labels conveniently to be picked up by the operator and applied to the hanger panel using the other hand. Thus, the operator can make efficient use of both hands and without the necessity of any awkward or difficult motions or assuming any difficult or tiring positions to apply the labels accurately to the hangers. Further, the application can be made rapidly and efficiently.

Having described a preferred embodiment of the invention, it will be recognized that modifications of the invention can be made without departing from the principles of the invention, such modifications are to be considered as included in the hereinafter appended claims, unless these claims, by their language, expressly state otherwise.

We claim:

1. A label dispenser adapted to be held in one hand comprising a thin rectangular body having a central panel characterized by flat top and bottom surfaces and a pair of upstanding sides forming a central recessed channel, said channel being open at both ends and of a width to receive and guide a ribbon-like label bearing web as it is moved lengthwise of said channel; between said sides the upper surface of said panel forming the bottom of said channel being smooth and flat whereby a web may slide over it with minimal friction; a slot adjacent one end of said channel extending from one side of the channel to the other; a bar extending between said sides defining the outer wall of said slot and having its upper surface co-planar with the bottom of said channel; a pair of ears, one projecting inwardly from each of said sides into said channel adjacent said slot and spaced from the plane of the upper surface of said panel a distance sufficient to permit a label transport web and the labels thereon to pass between them and said panel surface without interference, said ears collectively extending a minor portion of the width of the channel whereby a passage is provided between them of a width to permit an operator's thumb to pass the entire length of the body without obstruction, the wall of said slot intersecting the surface of the bottom of said channel at a major angle whereby said web is caused to make an abrupt change in direction and the labels on the web caused to separate from the web as the web initiates its directional change on passing into the slot and to be deposited on the top surface of said bar and extend outwardly generally parallel with the surface of said channel; the bottom surface of said panel having the same surface characteristics as the upper surface thereof forming the bottom of said channel; the width of said body being such that it can be seated in the palm of the operator's hand with the operator's thumb in a position to engage the web before it reaches the slot and the end of an operator's index finger can engage the central portion of the web and press and manipulate it against the panel's bottom surface whereby by simultaneous manipulation of the operator's thumb and index finger the web can be caused to move lengthwise of the dispenser to discharge its labels at said other end of the channel.

* * * * *